United States Patent [19]

Hosaka et al.

[11] 4,365,888

[45] Dec. 28, 1982

[54] ELECTROSTATIC COPYING APPARATUS

[75] Inventors: Masao Hosaka; Yoshitaka Ogino; Nobuyuki Yanagawa, all of Tokyo, Japan

[73] Assignee: Ricoh Company, Ltd., Tokyo, Japan

[21] Appl. No.: 201,872

[22] Filed: Oct. 29, 1980

[30] Foreign Application Priority Data

Nov. 5, 1979 [JP] Japan ..... 54-143048

[51] Int. Cl.[3] ..... G03G 15/00

[52] U.S. Cl. ..... 355/14 R

[58] Field of Search ..... 355/14 CU, 14 R, 3 R, 355/16

[56] References Cited

U.S. PATENT DOCUMENTS

| | | | |
|---|---|---|---|
| 3,912,390 | 10/1975 | Van Herten | 355/14 R |
| 4,110,033 | 8/1978 | Ophey | 355/14 R |
| 4,252,432 | 2/1981 | Ophey | 355/14 R |

*Primary Examiner*—R. L. Moses

*Attorney, Agent, or Firm*—David G. Alexander

[57] ABSTRACT

A drive motor (3) for a photoconductive belt (1) is energized for continuous rotation and connected to the belt (1) through a clutch. The clutch is disengaged and the belt (1) held stationary while an electrostatic image of an original document is formed on the belt (1). Then, the clutch is engaged and the belt (1) driven for developing the electrostatic image into a toner image and transferring and fixing the toner image to a copy sheet. The motor (3) also drives a pulse generator (18) which produces timing pulses. The timing pulses are counted by a counter. A control unit (E19) such as a microcomputer (19) controls the operation of the apparatus in accordance with predetermined counts in the counter. Marks ($15_1$), ($15_2$) are provided on the belt (1) in spaced relation. A compensation unit senses the number of timing pulses counted by the counter between sensing of the marks ($15_1$), ($15_2$). If the number of timing pulses counted is within a predetermined range which contains a predetermined value but is different from the predetermined value, the predetermined value is set into the counter, thereby compensating for slippage of the belt (1) relative to the motor (3). If the number of timing pulses counted is outside the predetermined range, an alarm is energized. Provision is also made for sensing a period of the timing pulses and energizing an alarm if the period is outside a predetermined range.

18 Claims, 15 Drawing Figures

| Fig. 3a | Fig. 3b | Fig. 3c |
|---|---|---|

ELECTROSTATIC COPYING APPARATUS

BACKGROUND OF THE INVENTION

The present invention relates to a copying apparatus which forms a latent image electrostatically on a photosensitive element in the form of a belt or a sheet by projecting a light image thereonto and then developing it and transferring the developed toner image onto a recording or copy sheet.

A copying apparatus of the type described conventionally employs a photosensitive element which may take the form of a drum, a belt or a sheet. Like a photosensitive drum, a photosensitive belt or sheet is driven continuously at a constant speed while undergoing various major copying steps such as charging, exposing, developing and transferring. A problem inherent in the use of a photosensitive belt or sheet is that slippage tends to occur between the belt or sheet and rollers adapted to feed it. The slippage is liable to prevent the actual processing timing in each of the copying steps from coinciding with predetermined ones. Complete recording may fail even after the predetermined timings are over or the recorded image may have deviations in small and/or large sections.

In a known system, a photosensitive element drive train is provided with a timing pulse generator (encoder) made up of a slotted plate and a photosensor. This system counts timing pulses from the generator from a start of copying operation and energizes various elements at timings based on the counts of the timing pulses. However, even though the mechanical elements may operate properly, a slippage whether temporary or continuous between the elongate photosensitve element and rollers will shift the actual charging, exposing and other timings either partly or entirely from the operating timings of the mechanism. This prevents a desired image pattern from being reproduced. During a series of continuous copying cycles, the shift or deviation will remain within the range of each copy if the count is reset copy by copy. If this count is not reset, however, the deviation in timing will accumulate and become more critical as the copying cycle is repeated.

SUMMARY OF THE INVENTION

A primary object of the present invention is, in a copying process using a photosensitive belt or a photosensitive sheet, to form an image pattern on the belt or sheet without any deviation.

Another object of the present invention is to record images on sheets without deviation.

Another object of the present invention is to reduce deviation of processing timings attributable to the photosensitive element.

A further object of the present invention is to avoid accumulation of deviation.

In one aspect of the present invention, there is provided a copying apparatus in which charge deposition and exposure for one document are performed on a photosensitive belt or sheet while keeping it stationary. The belt or sheet can be stretched with a relatively freely selectable surface configuration such as a flat or curved shape and, therefore, it can be positioned relatively easily such that image patterns are projected onto various areas of its surface without distortion or density variation in conformity with specific projection characteristics of an optical exposing system. In a simple design, the belt or sheet may have at least its exposure surface positioned flat. In this case, it is preferable that the exposure surface face a document, that a light source and mirrors with or without a slit be positioned between the exposure surface and document, and that such components for exposure be moved for exposure along the surface concerned. Another preferable arrangement may employ an optical system made up of a light source and an optical fiber head having light-converging optical fibers arranged into an integral array and, with these components, carry out exposure in the manner mentioned above. This second arrangement is particularly advantageous in that the optical exposing system requires only a small number of component elements, in that the positioning and the like are easy and in that images can be recorded with high resolution.

For depositing a charge on the belt or sheet before exposure, the belt or sheet may be driven at a constant speed relative to a charger which is energized. It is preferable, however, to mount the charger integrally on the optical exposing system and, while maintaining the belt or sheet stopped, move it together with the optical system so that the exposure surface on the stationary belt or sheet is charged and exposed simultaneously. This is because the stationary belt or sheet can be uniformly charged by the constant drive of a carriage (this can be carried out without deviation). Where the sheet or belt is moved relative to a stationary charger so as to be deposited with a charge, uneven charging cannot entirely be avoided because of possible slippage of the belt or sheet relative to drive rollers though the uneven charging due to slippage would not critically affect reproduced images. It is also desirable to mount on the carriage a high tension power source for applying a high voltage to the charger. If a high tension voltage source is fixed in place as conventional, it must be connected to the charger on the carriage by a movable and very long high tension wire. Connection of a low tension wire to the carriage suffices where such a power source is mounted on the carriage.

In this way, electrostatic latent images can be formed on the belt or sheet without any significant deviation or density fluctuation by a compact construction if the carriage has thereon a light converging optical fiber head, illumination lamp, charger and high tension power source and this carriage is driven to expose the stationary photosensitive surface to a image light.

The deviation of images reproduced on sheets may also be caused by improper timings of sheet feed and image transfer relative to the feed timing of a latent image on the belt or sheet. Furthermore, the developing timing and fixing timing (mainly in the case of flash fixing) affect the quality of reproduced images. These timings are liable to deviate from predetermined ones due to slippage of the belt or sheet which will be travelling during such processing steps.

Therefore, in another aspect of the present invention, there is provided a copying apparatus which predetermines major timings such as that of copy start by reading marks, slots, lugs, magnetic pieces or like indices provided to the belt or sheet. This provides a base point for the timing of each copying action and thereby avoids accumulation of deviation in timing in a continuous copying operation. Since precise timing at each processing step may fail to be determined merely by reading the indices on the belt or sheet, it is preferable to count pulses of a short period from the instant an index on the belt or sheet has been read and in this way determine each processing timing on the basis of the counts. In this case, if the count of timing pulses is compensated for the distance or time interval between the indices every time an index is read and, from the compensated count the counting operation is continued, accumulation of deviation in timing attributable to deviation in the feed of the belt or sheet can be minimized even in the processing of a single copy. Dislocation of an image pattern on a sheet is mainly caused by the feed of a sheet to a transfer station at an improper timing relative to the feed timing of a latent image (or vice versa). For this reason, it is desirable that the indices on the belt or sheet be located such that, after the counting of timing pulses which follows detection of one index, the count is compensated upon detection of a second index and, immediately after this compensation, feeding of a sheet is started. The count is compensated in accordance with the actual position of the belt or sheet before the starting point of a sheet feed timing.

An electrostatic copying apparatus embodying the present invention includes a photoconductive member, imaging means for forming an electrostatic image of an original document on the photoconductive member, developing means for developing the electrostatic image to form a toner image, transfer means for transferring the toner image to a copy sheet and a drive motor for driving the photoconductive member and is characterized by comprising mark means provided on the photoconductive member, sensor means for sensing the mark means and producing signals in response thereto, pulse generator means driven by the motor for generating timing pulses, counter means for counting the timing pulses, control means for controlling the imaging means, developing means and transfer means in accordance with predetermined counts in the counter means, and compensation means for resetting the counter means in response to a first signal from the sensor means, sensing a count in the counter means in response to a second signal from the sensor means and, when the sensed count is different from a predetermined value, setting the counter means to the predetermined value.

In accordance with the present invention, a drive motor for a photoconductive belt is energized for continuous rotation and connected to the belt through a clutch. The clutch is disengaged and the belt held stationary while an electrostatic image of an original document is formed on the belt. Then, clutch is engaged and the belt driven for developing the electrostatic image into a toner image and transferring and fixing the toner image to a copy sheet. The motor also drives a pulse generator which produces timing pulses. The timing pulses are counted by a counter. A control unit such as a microcomputer controls the operation of the apparatus in accordance with predetermined counts in the counter. Marks are provided on the belt in spaced relation. A compensation unit senses the number of timing pulses counted by the counter between sensing of the marks. If the number of timing pulses counted is within a predetermined range which contains a predetermined value but is different from the predetermined value, the predetermined value is set into the counter, thereby compensating for slippage of the belt relative to the motor. If the number of timing pulses counted is outside the predetermined range, an alarm is energized. Provision is also made for sensing a period of the timing pulses and energizing an alarm if the period is outside a predetermined range.

It is another object of the present invention to provide a generally improved electrostatic copying apparatus.

Other objects, together with the foregoing, are attained in the embodiments described in the following description and illustrated in the accompanying drawing.

BRIEF DESCRIPTION OF THE DRAWING

FIGS. 5*a–l* and 5*a–z* form a timing chart showing an operation for producing a single copy;

FIGS. 5*b–l* and 5*b–z* form a timing chart for producing a plurality of copies in a continuous operation;

FIGS. 6*a–l*, 6*a–z* and 6*b* are flow charts demonstrating the control of copying operation.

DESCRIPTION OF THE PREFERRED EMBODIMENTS

While the electrostatic copying apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
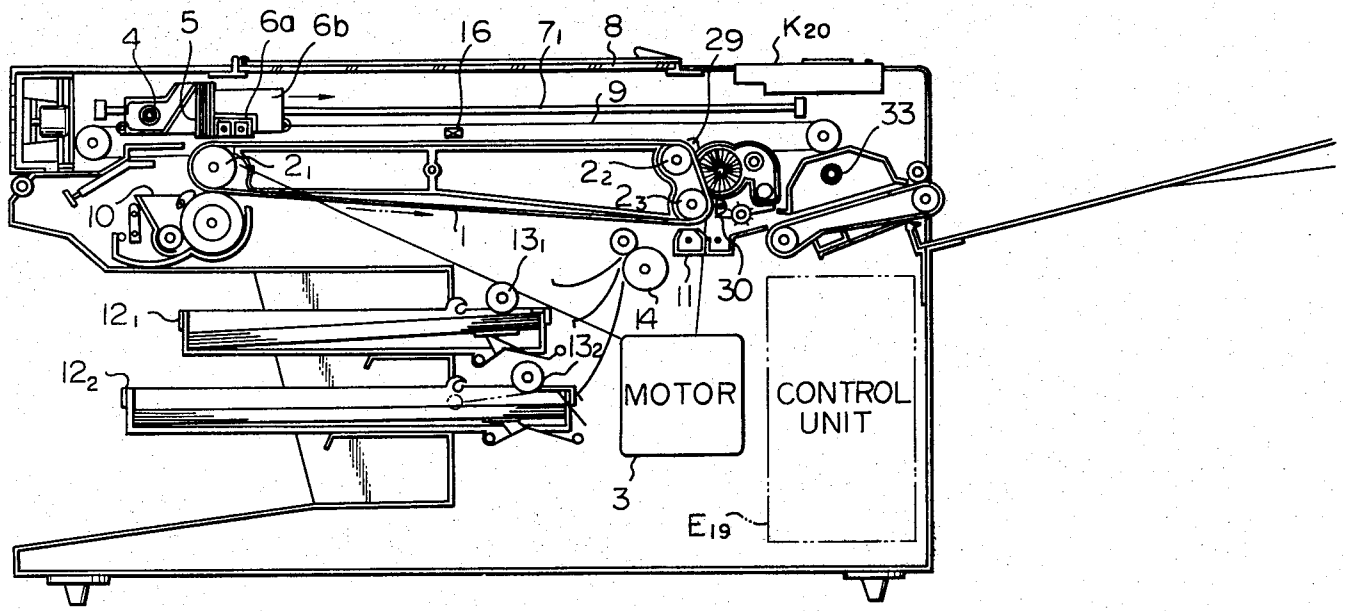
FIG. 1 shows in sectional side elevation a major part of the construction of a copying machine to which the present invention is applicable.

Referring to FIG. 1, there is shown a copying machine to which the present invention is applicable. The machine includes a photoconductive or photosensitive belt 1 passed over three feed rollers $2_1$–$2_3$ which are in turn connected through a clutch or belt clutch to a motor unit 3. The motor unit 3 has therein a gear reduction mechanism and a motor. A carriage (not shown) is movable on and along a pair of parallel guide bars $7_1$ and $7_2$ (though the guide bar $7_2$ does not appear in the drawing) in parallel with the upper run of the belt 1 and a flat glass platen 8. A wire 9 is in driving connection with the movable carriage. Rigidly mounted on the carriage are a light source 4 in the form of a lamp, an optical fiber array or head 5 of the light converging type, a charger 6*a* and a power source 6*b* for the charger 6*a*. Supported by turn pulleys, the wire 9 is driven by the motor unit 3 through a clutch for a forward stroke (indicated by an arrow in the drawing) and a return stroke. As will be described, the lamp 4 remains turned on and the charger 6*a* energized while the carriage is travelling its forward stroke to illuminate an area of the photosensitive belt surface corresponding to a selected image size (e.g. format A3, B4, A4 or B5) on the glass platen 8 with a light image through the optical fiber head 5. During this period, the belt 1 is held stationary. With this system, charging and exposure of the belt 1 are carried out through the movement of the carriage. This kind of carriage drive can be performed at a stable speed without slippage and, therefore, permits an electrostatic latent image to be formed with high quality on the upper surface of the belt 1. After the exposure, the belt 1 moves in the counterclockwise direction and, at this instant, a developing unit 10 is activated to develop the latent image on the belt 1 into a toner image.

Where only one copy is desired, the belt 1 is driven continuously even after the development while a copy sheet is fed from a selected one of upper and lower sheets cassettes $12_1$ and $12_2$ by feed rollers $13_1$ or $13_2$ to registration rollers 14 and therefrom to a transfer charger 11. The timing of this sheet feed from the sheet cassette is such that the leading end of the sheet reaches the transfer charger 11 at the instant the leading end of the developed image on the moving belt 1 arrives at the transfer charger 11. Where "n" copies are to be produced in succession, the belt 1 is stopped when the first latent image has been developed and the second latent image is formed by exposure on the other half of the belt 1 which is then the upper half. Then the belt 1 is driven again so that the development of the second latent image and the transfer of the first toner image are carried out simultaneously. Thereafter, the belt 1 is stopped again for the third exposure which is followed by the development of the third latent image and transfer of the second toner image. Such a procedure will be repeated until "n-l" copies are produced. Then the final or n-th copy will be produced in the same way as the production of a single copy.

Figure 2A:
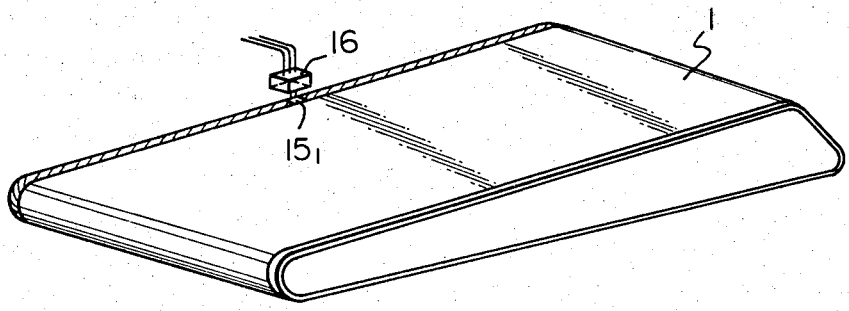
FIGS. 2*a* and 2*b* are enlarged perspectives of two different elements included in the copying machine.

In the illustrated embodiment, such overlapped processing is made possible by making the length of the belt 1 double the length necessary for producing one copy which is the sum of the maximum allowable copying size and some marginal areas. Naturally, the belt 1 may be three times or more the length required for producing one copy. As viewed in FIG. 2*a*, a piece of aluminum foil $15_1$ is bonded to a predetermined position of one of opposite lateral edge portions of the belt 1. Though not shown in the drawing, another piece of aluminum foil $15_2$ is bonded to the same edge of the belt 1 but at a position which is distant from the foil piece $15_1$ by ½ of the overall length along the belt edge. A reflection type photosensor 16 is fixed in place for detecting the foil pieces $15_1$ and $15_2$. When the photosensor 16 senses the foil piece $15_1$ or $15_2$ on the movable belt 1, a start point of a series of copying actions will be determined, the counted value will be compensated, the copying actions will be stopped and, in this way, major operating timings of the machine will be controlled.

Figure 2B:
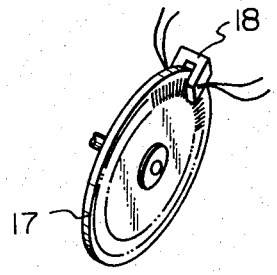

The motor unit 3 is designed continuously rotate during the copying operation of the machine. As shown in FIG. 2*b*, a slotted disc 17 is mounted on a shaft, gear or other constantly rotated mechanical element of the motor unit 3 while a photosensor 18 of the light transmitting type is so positioned as to sense the slots of the plate 17. Outputs of the photosensor 18 are delivered as timing pulses through an amplifier circuit for amplification and wave-shaping. In this embodiment, the slotted disc 17, photosensor 18 and amplifier circuit constitute a timing pulse generator. As will be discussed below, the precise timing of each of various copying steps is determined on the basis of the number of timing pulses counted. The counting operation will be started and the count compensated on the basis of the outputs of the photosensor 16.

A section indicated by a broken line E19 in FIG. 1 has therein a central control unit and major electric elements and circuits. They receive command signals and codes from a keyboard K20.

Figures 3, 3A:
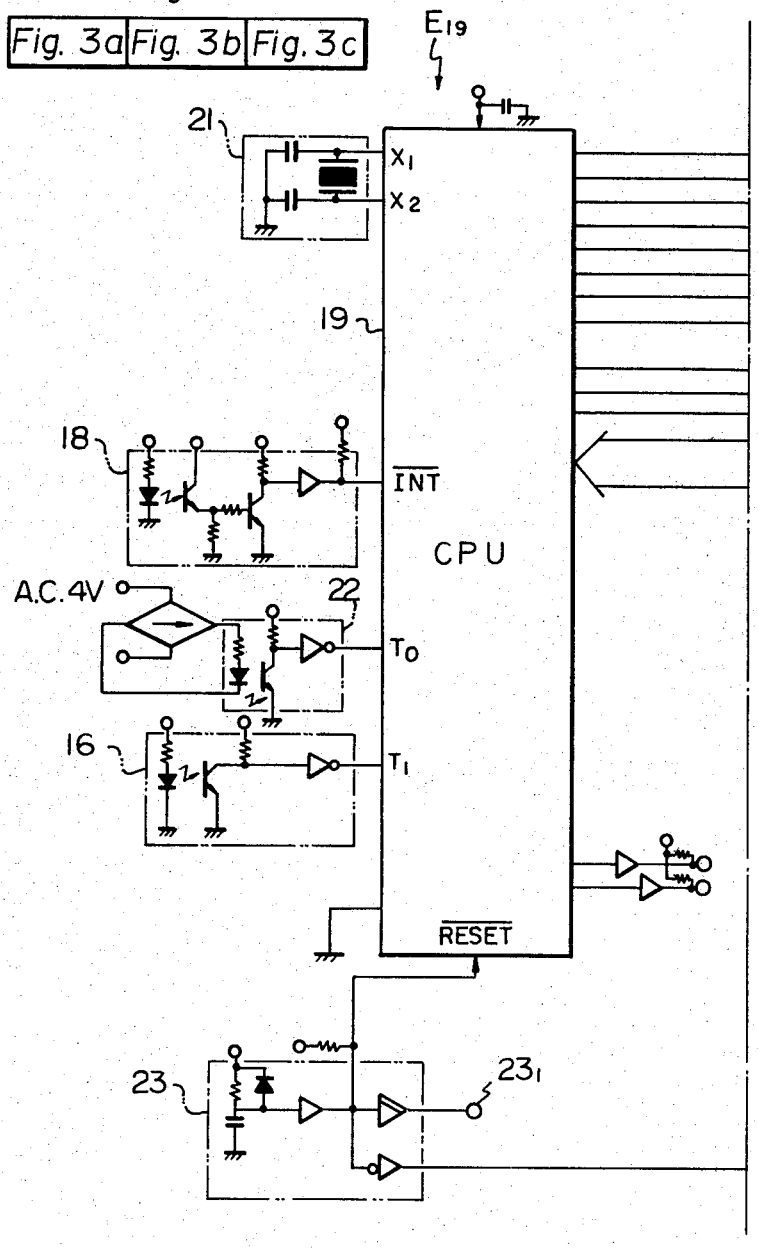
FIGS. 3*a*, 3*b*, 3*c* form a block diagram showing a combination of a central control unit of the copying machine and its associated electric circuit elements.
Figure 3B:
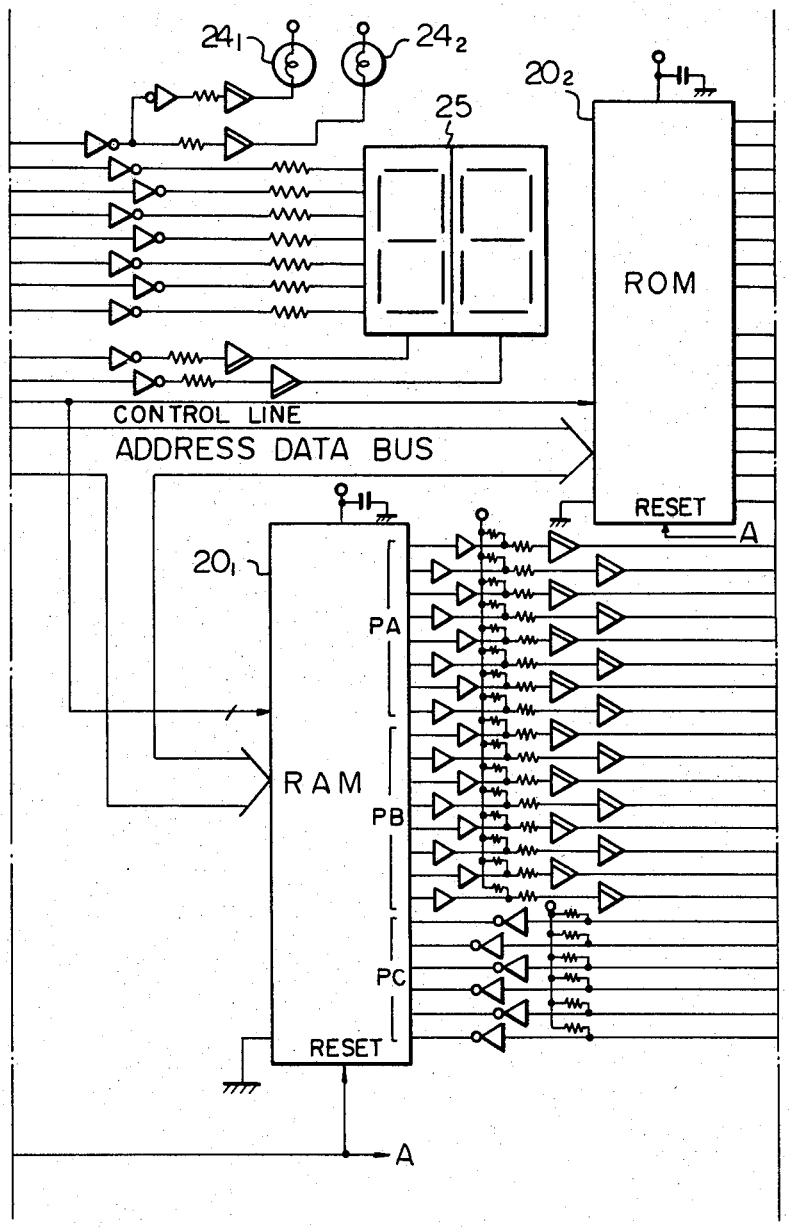
Figure 3C:
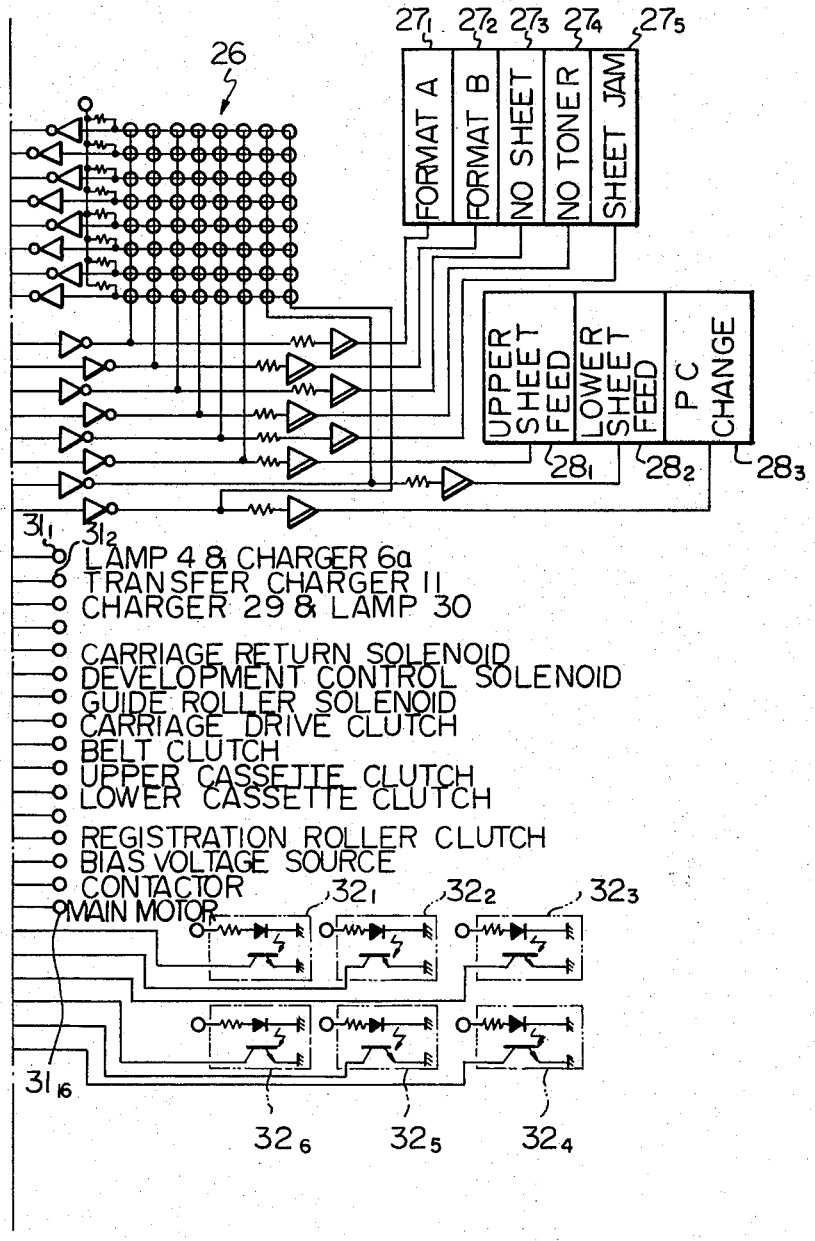
Figure 4:
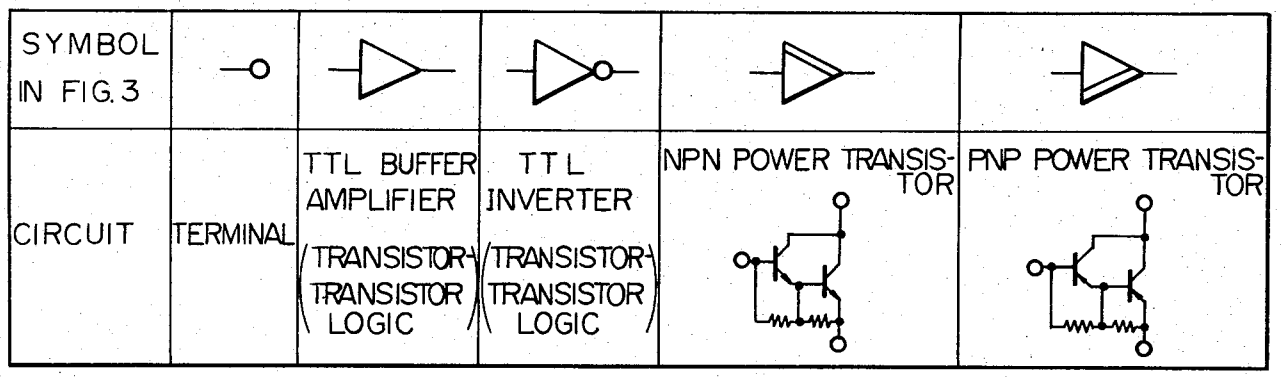
FIG. 4 is a key for symbols shown in FIG. 3.

FIG. 3 shows the central control unit E19 and its associated major electrical control elements. The central control unit E19 is made up of a 1-chip microcomputer 19, semiconductive read-only memory or ROM $20_2$ and a random access memory or RAM $20_1$ having an I/O port. Connected with the microcomputer 19 are a pulse oscillator 21, the photosensors 16 and 18, a zero-cross detection circuit 22, a reset circuit 23, a lamp $24_1$ (blue) indicating "copy enable", a lamp $24_2$ (red) indicating "copy inhibit" and a 2-digit, 7-segment display 25. Various elements are connected in the same way with the I/O ports of the ROM $20_2$ and RAM $20_1$. Connected with the ROM $20_2$ are a set of movable and stationary key contacts 26 of the keyboard K20, display lamps $27_1$–$27_5$ and character displays $28_1$–$28_3$. Connected with the RAM $20_1$ are control output terminals $31_1$–$31_{16}$ and photosensors $32_1$–$32_6$. The photosensor $32_1$ detects separation of sheets, the photosensor $32_2$ detects sheets in the upper cassette $12_1$, the photosensor $32_3$ detects sheets in the lower cassette $12_2$, the photosensor $32_4$ senses toner density and the photosensor $32_5$ detects discharge of sheets. The symbols of the individual elements in FIG. 3 represent the circuits shown in FIG. 4. When the signal level at the input terminal of the reset circuit 23 becomes high or "1", a relay connected with a terminal $23_1$ will be energized to turn on the power source for each DC circuit section. When the signal level becomes low or "0", the power supply will be cut off with the components 19, $20_1$, and $20_2$ reset.

Figures 1, 5A:
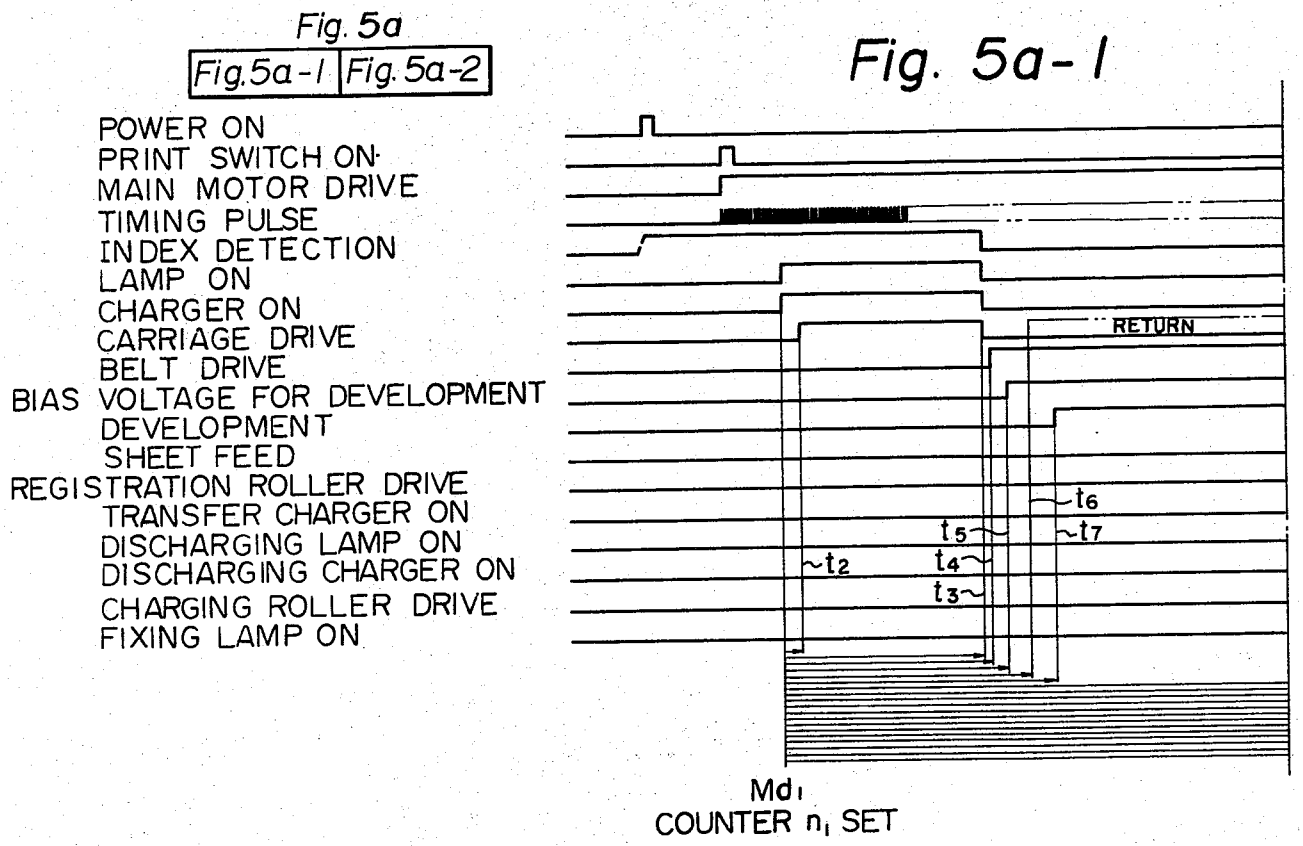
Figures 2, 5A:
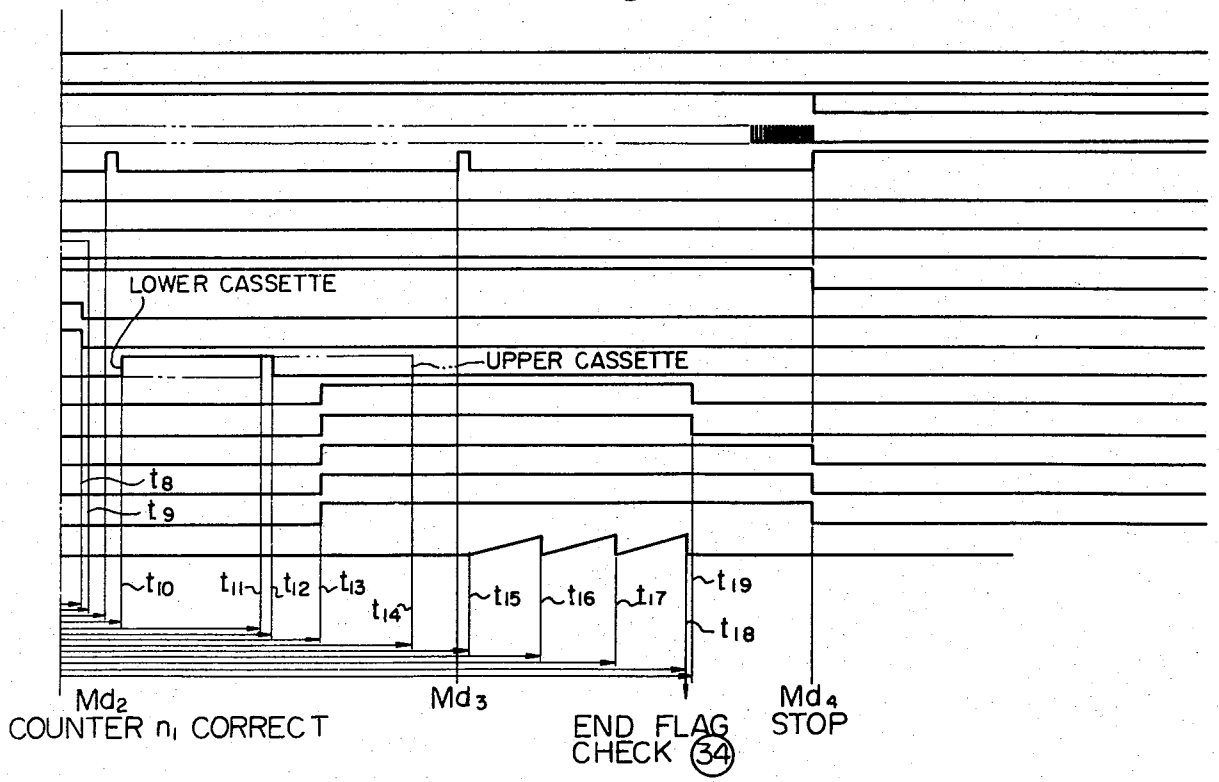
Figures 1, 5B:
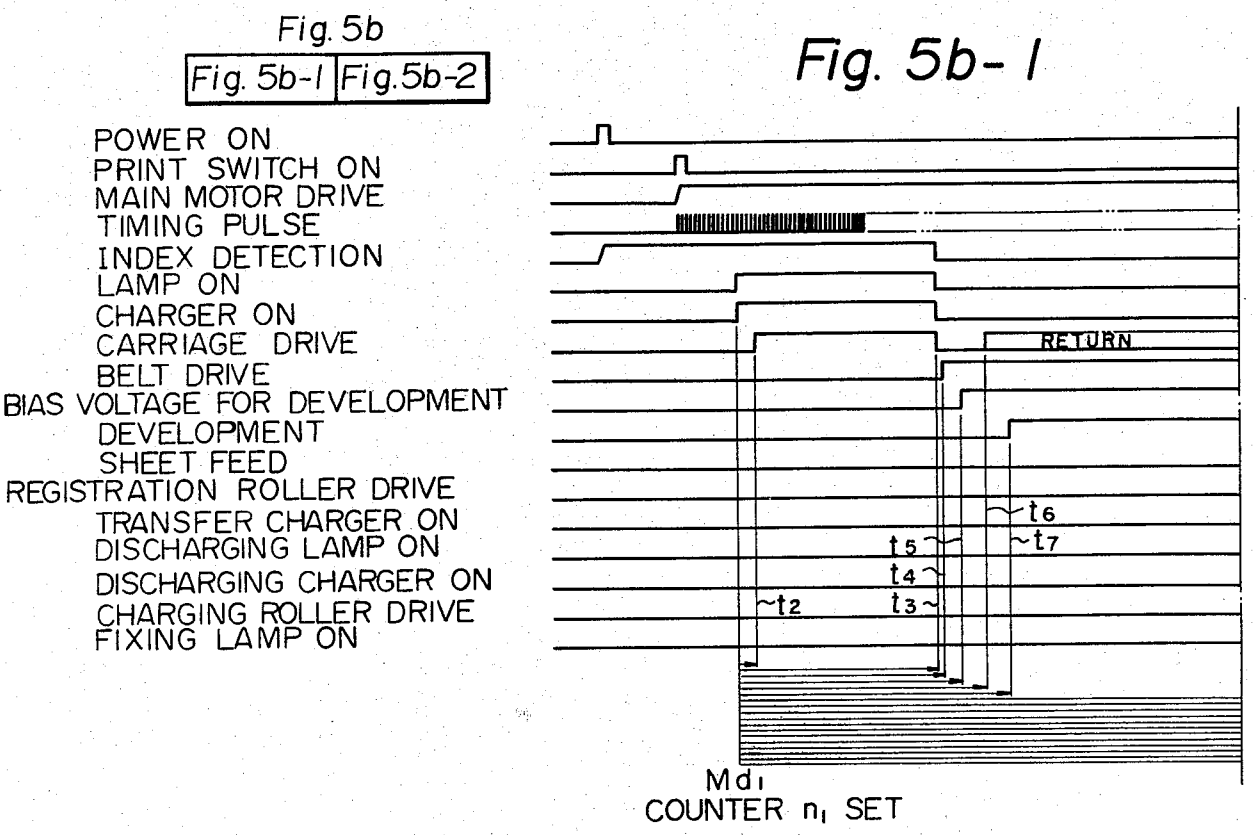
Figures 2, 5B:
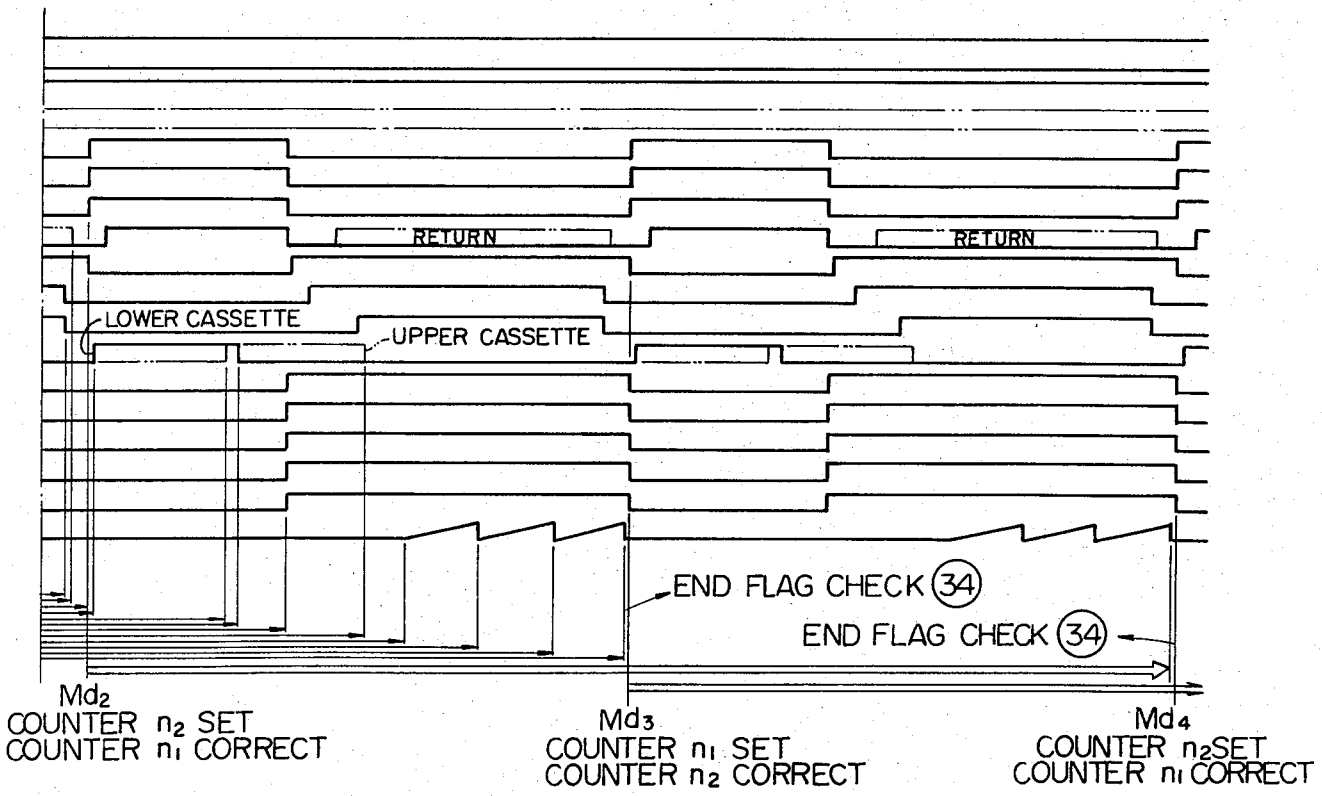

The ROM $20_2$ and an internal ROM of the microcomputer 19 store therein program data for latching, reading and displaying changes in the states of the keyboard K20 and sensors in various sections in response to their output signals and constant data which will be referred to for such operation. Control timings will be described hereinafter concentrating particularly on the steps of charging, exposing, developing, sheet feeding and image transferring which are relevant to the present invention. Control timings for producing a single copy are shown in FIG. 5*a*. Those for producing multiple copies in succession are shown in FIG. 5*b* except for the final copy which will be produced by timings similar to those of FIG. 5*a*. It should be born in mind that the control timings of FIGS. 5*a* and 5*b* apply when copies of format A4 are to be produced. For the other formats, different constants related to the formats will be used and, hence, the control timings will have predetermined deviations from those of FIGS. 5*a* and 5*b*.

Figures 1, 6A:
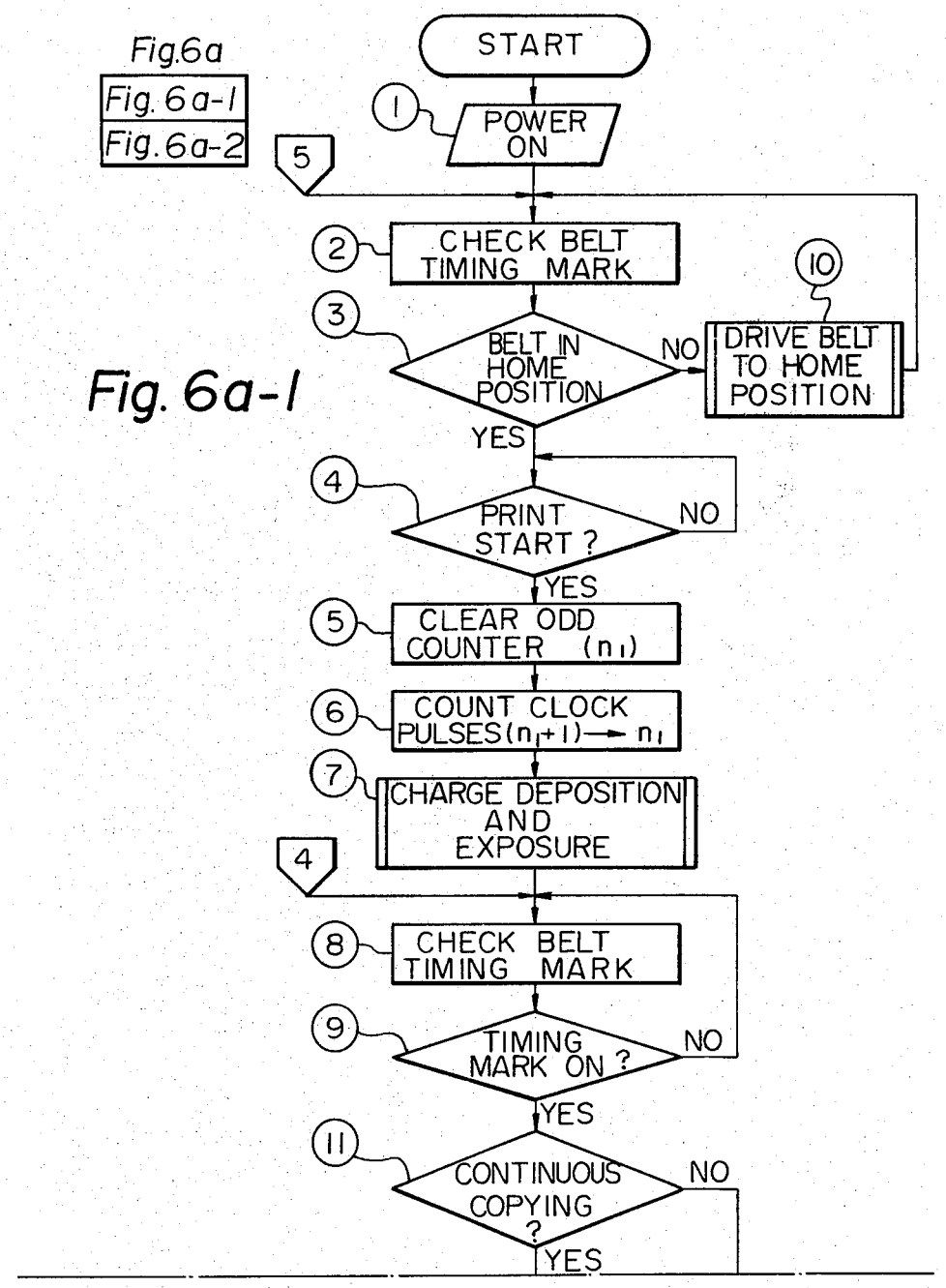
Figures 2, 6A:
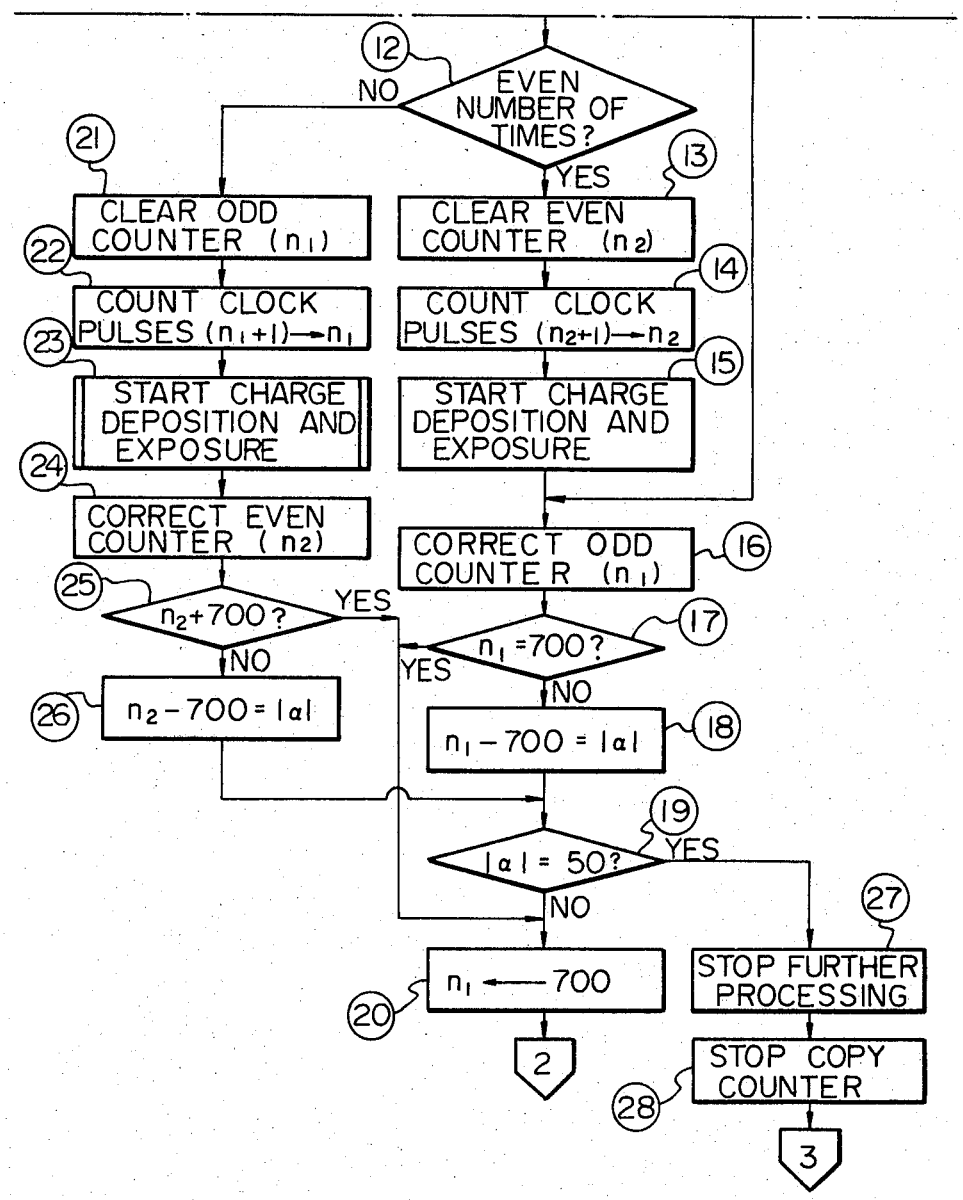
Figure 6B:
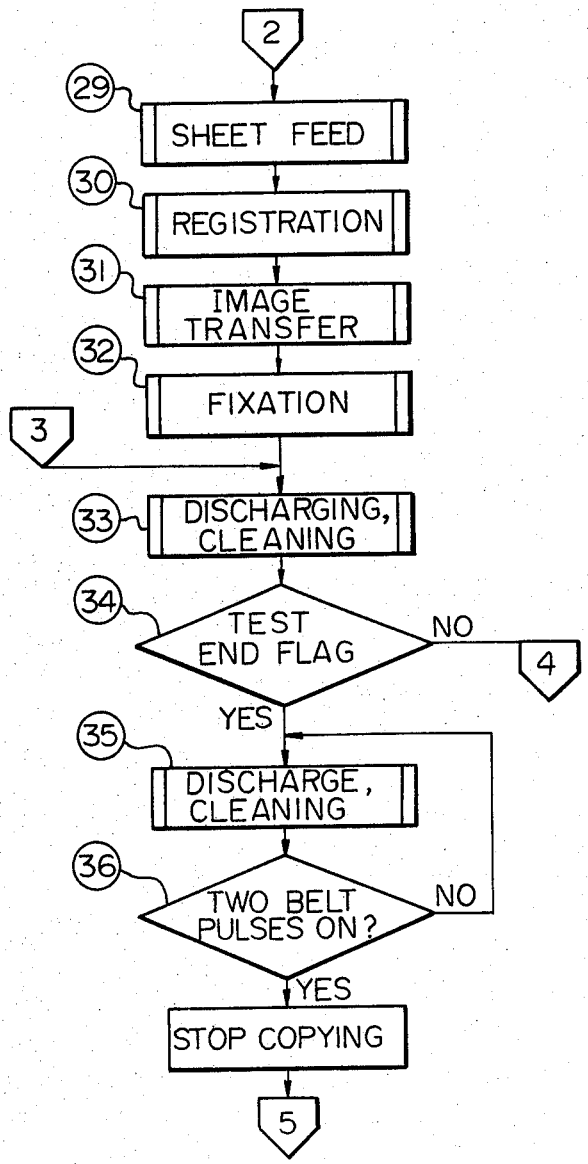

Referring to FIGS. 6*a* and 6*b*, the power source is first turned on to make the input signal level of the reset circuit 23 "1" (step ①). Then, whether the sensor 16 has detected the foil piece $15_1$ (or $15_2$) on the belt 1, or whether the belt 1 is in its home position is checked (step ②). If the belt 1 is displaced from the home position, the motor unit 3 will be energized and the belt clutch engaged to rotate the belt 1 until the sensor 16 senses the foil piece $15_1$ or $15_2$ (step ⑩). When the belt 1 is in or has reached the home position, the system awaits closing of a print switch (one of the keys 26). Upon closing of the print switch, the system starts its copying operation (step ④). First, the motor unit 3 is energized and an odd counter (referred to as odd counter $n_1$ hereinafter) is set to the count of the timing pulses (steps ⑤ and ⑥). The counter may be either an internal counter of the microcomputer or an independent counter. In this embodiment, use is made of a program counter consisting of a certain storage region of the microcomputer 6*a* which first stores "1" and, every time a timing pulse arrives, adds "1" to the stored data and replaces the stored data with the sum. As the count of the counter $n_1$ reaches a first predetermined value ($Md_1$), the counter is cleared and re-starts counting timing pulses while the lamp 4 is turned on and the charger 6*a* is supplied with voltage. At the instant a second predetermined value $t_2$ is reached, the clutch is engaged to drive the carriage. Then at a third predetermined value $t_3$ corresponding to the selected format, the clutch is disengaged and the lamp 4 and charger 6*a* are de-energized to complete the exposure. As the count reaches $t_4$, the belt clutch is coupled to drive the belt 1. At a count $t_5$, a bias voltage for development is applied. At a count $t_6$, a turn solenoid and the clutch are energized to drive the carriage for return stroke and, at count $t_7$, development begins. Then, at a count $t_8$, the development is stopped and, at a count $t_9$, whether the carriage has arrived at the home position is determined. For this purpose, a sensor responsive to the return of the carriage to the home position is employed. These actions occur at step ⑦ . Thereafter, the system waits until the sensor 16 senses the foil piece $15_2$ (or $15_1$) at steps ⑧ and ⑨ . Upon detection of the foil piece $15_2$, it is determined whether the preset number of copies is one or more (step ⑪ ). At the instant the sensor 16 has sensed the foil piece $15_2$, a fresh photosensitive area of the belt surface corresponding to one page will have reached a position beneath the glass platen 8.

If the preset copy number is one, meaning that continuous copying operation is needless (FIG. 5*a*), the count of the operating odd counter $n_1$ is compensated (steps ⑯ - ⑳ ). First, the counter $n_1$ has its count checked or sensed (step ⑰ ) regarding whether the count is equal to or different from a predetermined number 700, the number of timing pulses which should be counted at the end of travel of the belt 1 by a distance equal to ½ of its length without any slippage. If the count is equal to 700 meaning that the belt 1 did not slip, the operation advances to step ㉙ with the count unchanged. If different, the count is compared with the reference number or value 700 to obtain the absolute value $|\alpha|$ of the difference $\alpha$ (step ⑱ ) and whether the absolute value lies within a predetermined allowable range 50 is determined (step ⑲ ). If, so, the counter $n_1$ is loaded with 700 and caused to keep on counting (compensation of the count). If not, the following processing is interrupted to determine if the difference is too much to permit any further use of the machine (step ㉗ ) and, without causing a copy counter to upcount (step ㉘ ), the operation is interrupted and a predetermined procedure carried out (step ㉝ and onward). The machine is reset to its standby state without performing any further copying cycles. If desired, at step 27 or 28, a buzzer, lamp or other alarm may be energized to call a service person or indicate the need for inspection or repair. When the counter $n_1$ reaches a count $t_{10}$, the feed rollers $13_2$ are driven if the designated sheet cassette is the lower one $12_2$. If the designated sheet cassette is the upper one $12_1$, the feed rollers $13_1$ are driven at a count $t_{11}$ (step ㉙ ) and then stopped at a count $t_{12}$. At a count $t_{13}$, image transfer and cleaning are started and, at a count $t_{14}$, the sheet feed from the upper sheet cassette $12_1$ is stopped (steps ㉚ and ㉛ ). Then, even if the sensor 16 detects the foil piece $15_1$ on the belt 1, a power source for flash fixing is turned on at a count $t_{15}$ without compensating the count of the counter $n_1$. At counts $t_{16}$, $t_{17}$ and $t_{18}$, a flash lamp 33 is triggered for dissipating the charge whereupon, at a count $t_{19}$, the sheet feed and image transfer are stopped. At the instant the foil piece $15_2$ has been detected, or upon arrival of two successive detection outputs after the compensation of the counter $n_1$, the motor unit 3 is deactivated while charge-expelling and cleaning steps are completed. In this stop position, if the foil piece $15_1$ (or $15_2$) was detected by the sensor 16 at the first predetermined value $Md_1$, the belt 1 will be in its home position wherein the sensor 16 detects the foil piece $15_2$ (or $15_1$). Therefore, by this time, a photosensitive area on the belt 1 different from that used for the first copying operation will have reached a position just below the glass platen 8. It will thus be seen that, even in the case of production of a single copy, two different photosensitive areas on the belt 1 are used alternately with even frequency. As will be noted, the end flag is checked immediately after the count $t_{18}$ and, if it indicates that the copying operation for selected number of copies has completed, termination at the aforementioned $Md_4$ will occur.

Now, when it is determined at the step 11 that a plurality of copies are to be produced continuously, whether the copying cycle is of the odd or even order is checked (step ⑫ ). If it is an even copying cycle $Md_2$, $Md_4$ . . . ), the operation shown in FIG. 5*b* takes place. An even counter $n_2$ is set to the count while, based on this count, control timings for charge deposition and exposure are determined (steps ⑬ - ⑮ ). Whether the process can proceed is determined by checking whether the difference between the count of the counter $n_1$ and reference number 700 lies within the allowable range 50, and then the count of the counter $n_1$ is corrected or the processing is interrupted as already discussed (step ⑯ and onward). If the copying cycle is of an odd number ($Md_3$, . . . ), the even counter $n_1$ is set to the count (steps ㉑ - ㉒ ) and control timings for charge deposition and exposure are determined on the basis of the count. Concurrently, whether the difference between the count of the counter $n_2$ and reference number 700 is within the allowable range 50 is determined to see whether the process can proceed. Then, as described, the count of the counter $n_2$ is corrected or the processing is stopped.

In this way, an odd counter and an even counter are used alternately in a continuous copying operation such that one of them is set and the other corrected or compensated every time the sensor 16 detects the foil piece $15_1$ or $15_2$. Accordingly, as shown in FIG. 5*b*, an odd copy and an even copy are processed in an overlapped manner though the steps are different from each other. The same holds true when the belt 1 has a length corresponding to three times or more of the maximum allowable size.

Regardless of the intended number of copies, sheet feed setting occurs at a time remote from the time of counter setting. Nevertheless, exact positioning of a copy sheet is achievable relative to a toner image on the moving belt 1. This is because the count of the counter is corrected before sheet feed setting by reading a foil piece and the timing is corrected in correspondence with the actual position of the belt 1. A cumulative error up to that instant due to slippage of the belt 1 is cancelled. Additionally, the time interval between the reading of a foil piece and count correction and the sheet feed setting is very short.

Now, the charge deposition and exposure performed with the belt 1 held stationary permits a latent image to be formed on the belt 1 without any significant dislocation. Also, the correction of the count of timing pulses based on the detection of a foil piece promotes, mainly, exact positioning of a paper sheet relative to a toner image on the belt 1. Yet, the timing pulses are liable to be disturbed though the probability is not so large as that of the slippage of the belt 1. This tends to occur particularly when the drive system inclusive of the motor unit 3 has its operation disturbed during stopping of the belt 1 or when the output pulses of the encoder (timing pulse generator) become irregular. The result is disturbance of the count which makes an adequate processing sequence impractical.

Figure 7:
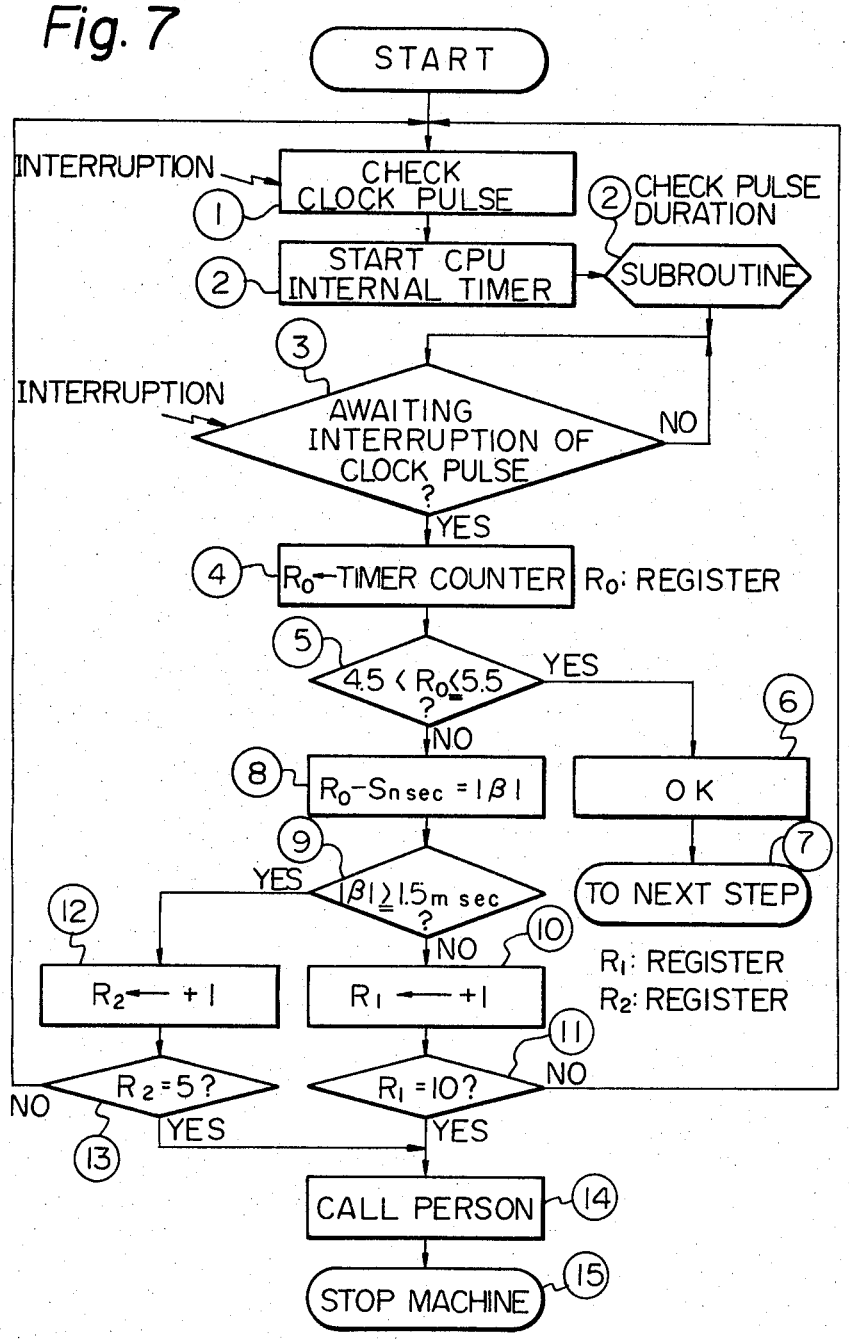
FIG. 7 is a flow chart indicating a timing pulse monitoring flow which occurs in response to an interrupt.

With this in view, the embodiment mentioned hereinabove also has an interrupt flow for monitoring the timing pulses. Referring to FIG. 7 which shows this additional flow, the microcomputer 19 has an internal timer counter which is activated (step ②) when a timing pulse 1 coupled from the timing pulse generator 18 to its interrupt terminal $\overline{INT}$. In this embodiment, the microcomputer 19 is the Intel 8049 while use is made of a 6 MHz quartz oscillator. The timer counter upcounts 80 μs pulses produced by frequency division within the microcomputer 19 as one unit, the microcomputer 19 awaiting interrupt until the next timing pulse arrives (step ③). Upon arrival of the second timing pulse, the count of the timer counter is shifted to a register $R_0$ (step ④) and the period of timing pulses is checked (step ⑤). If the actual period of the timing pulses lies within the allowable range of 4.5–5.5 msec which contains a reference timing pulse period which is 5 msec, it is determined proper and the processing advances to the next step (steps ⑥ and ⑦). If the actual pulse period is outside of the allowable range, the difference $|\beta|$ of the actual and reference periods is determined (step ⑧). If this difference is 1.5 msec or more, 1 (one) is loaded in a register $R_2$ and the number of times this has occurred is stored therein by addition. When the number increases beyond 5 (five), a service person is called for or the need of inspection or repair is indicated by alarm while inhibiting an further copying operation. If the difference is less than 1.5 msec, a register $R_1$ stored 1 (one) and also the sum of these occurrences which may progressively increase. When this number goes above 10 (ten), the same actions as those of the first case will take place. It will be noted that the registers $R_1$ and $R_2$ are cleared when the actual pulse period remains within the range of 4.5–5.5 msec and, hence, the measure against such unusual condition is taken only when the abnormal timing pulses appear in succession 5 times or more or 10 times or more. The failure data is stored in a non-volatile memory (not shown).

A step ②' in the flow of FIG. 7 indicates a routine for checking timing pulses whose durations are excessively long. When the slotted disc 17 becomes unmovable for one reason or another such as disengagement from the shaft, the output level of the photosensor 18 will be "1" or "0". This is detected at the step ②' and, then, the operation immediately advances to the process for correcting the unusual condition. It should be born in mind that, though the duration of the timing pulses becomes 5 to 10 times longer than usual immediately before and after start and stop of the motor, such timing pulses are not checked and this condition is not determined unusual.

While in the foregoing embodiment the count of a counter is set for correction purpose to a given number larger than zero in the event an index on the belt has been detected, the correction may be made by clearing the count to zero. Furthermore, the count may be corrected to zero by switching the counters from one to the other so as to utilize the count of the other counter which is to start counting for the subsequent operation. For instance, concerning the timings $t_{10}$–$t_{19}$ in FIG. 5*a*, the constant data may be determined in correspondence with counts which have the base point at $Md_2$.

In summary, it will be seen that the present invention provides an improved electrostatic copying apparatus which overcomes the problems involved with sippage of a photoconductive belt or the like relative to a motor shaft which drives a timing pulse generator. Various modifications will become possible for those skilled in the art after receiving the teachings of the present disclosure without departing from the scope thereof.

What is claimed is:

1. An electrostatic copying apparatus including a photoconductive member, imaging means for forming an electrostatic image of an original document on the photoconductive member, developing means for developing the electrostatic image to form a toner image, transfer means for transferring the tonner image to a copy sheet and a drive motor for driving the photoconductive member, characterized by comprising:

mark means provided on the photoconductive member;

sensor means for sensing the mark means and producing signals in response thereto;

pulse generator means driven by the motor for generating timing pulses;

counter means for counting the timing pulses;

control means for controlling the imaging means, developing means and transfer means in accordance with predetermined counts in the counter means; and compensation means for resetting the counter means in response to a first signal from the sensor means, sensing a count in the counter means in response to a second signal from the sensor means and, when the sensed count is different from a predetermined value, setting the counter means to the predetermined value;

the compensation means further comprising alarm means and means for energizing the alarm means when, in response to the second signal from the sensor means, the count in the counter means is outside a predetermined range which contains the predetermined value.

2. An apparatus as in claim 1, further comprising clutch means for coupling the drive motor to the photoconductive member, the control means disengaging the clutch means while the imaging means forms the electrostatic image on the photoconductive member.

3. An apparatus as in claim 2, in which the imaging means comprises a carriage, a charger, a light source and a linear optical fiber array mounted on the carriage and means for driving the carriage relative to the photoconductive member.

4. An electrostatic copying apparatus including a photoconductive member, imaging means for forming an electrostatic image of an original document on the photoconductive member, developing means for developing the electrostatic image to form a toner image, transfer means for transferring the toner image to a copy sheet and a drive motor for driving the photoconductive member, characterized by comprising:

mark means provided on the photoconductive member;

sensor means for sensing the mark means and producing signals in response thereto;

pulse generator means driven by the motor for generating timing pulses;

counter means for counting the timing pulses;

control means for controlling the imaging means, developing means and transfer means in accordance with predetermined counts in the counter means;

compensation means for resetting the counter means in response to a first signal from the sensor means, sensing a count in the counter means in response to a second signal from the sensor means and, when the sensed count is different from a predetermined value, setting the counter means to the predetermined value; and clutch means for coupling the drive motor to the photoconductive member, the control means disengaging the clutch means while the imaging means forms the electrostatic image on the photoconductive member;

the photoconductive member being in the form of a belt, the mark means comprising a first mark and a second mark spaced from the first mark in a direction of movement of the photoconductive member, the sensor means producing the first and second signals in response to sensing the first and second marks respectively, the control means disengaging the clutch means in response to the first signal, controlling the imaging means to form the electrostatic image on the belt and then engaging the clutch means, the control means controlling the transfer means to transfer the toner image to the copy sheet in response to the second signal.

5. An apparatus as in claim 4, in which the first and second marks are spaced from each other in such a manner as to divide the belt into two sections of equal length.

6. An electrostatic copying apparatus including a photoconductive member, imaging means for forming an electrostatic image of an original document on the photoconductive member, developing means for developing the electrostatic image to form a toner image, transfer means for transferring the toner image to a copy sheet and a drive motor for driving the photoconductive member, characterized by comprising:

mark means provided on the photoconductive member;

sensor means for sensing the mark means and producing signals in response thereto;

pulse generator means driven by the motor for generating timing pulses;

counter means for counting the timing pulses;

control means for controlling the imaging means, developing means and transfer means in accordance with predetermined counts in the counter means; and compensation means for resetting the counter means in response to a first signal from the sensor means, sensing a count in the counter means in response to a second signal from the sensor means and, when the sensed count is different from a predetermined value, setting the counter means to the predetermined value;

the counter means comprising first and second counters which are used alternatingly for producing a plurality of copies of the original document.

7. An apparatus as in claim 6, in which the compensation means is constructed to reset the first counter while sensing the count in the second counter and vice-versa.

8. An electrostatic copying apparatus including a photoconductive member, imaging means for forming an electrostatic image of an original document on the photoconductive member, developing means for developing the electrostatic image to form a toner image, transfer means for transferring the toner image to a copy sheet and a drive motor for driving the photoconductive member, characterized by comprising:

mark means provided on the photoconductive member;

sensor means for sensing the mark means and producing signals in response thereto;

pulse generator means driven by the motor for generating timing pulses;

counter means for counting the timing pulses;

control means for controlling the imaging means, developing means and transfer means in accordance with predetermined counts in the counter means; and compensation means for resetting the counter means in response to a first signal from the sensor means, sensing a count in the counter means in response to a second signal from the sensor means and, when the sensed count is different from a predetermined value, setting the counter means to the predetermined value;

the drive motor being energized for continuous rotation, the compensation means further comprising alarm means and means for energizing the alarm means when a period of the drive pulses is outside a predetermined range.

9. An apparatus as in claim 8, in which the compensation means is constructed to energize the alarm means only when periods of a predetermined number of drive pulses are sensed as being outside the predetermined range.

10. An electrostatic copying apparatus including a photoconductive member, imaging means for forming an electrostatic image of an original document on the photoconductive member, developing means for developing the electrostatic image to form a toner image, transfer means for transferring the toner image to a copy sheet and a drive motor for driving the photoconductive member, characterized by comprising:

mark means provided on the photoconductive member;

sensor means for sensing the mark means and producing signals in response thereto;

pulse generator means driven by the motor for generating timing pulses;

counter means for counting the timing pulses;

control means for controlling the imaging means, developing means and transfer means in accordance with predetermined counts in the counter means; and compensation means for resetting the counter means in response to a first signal from the sensor means, sensing a count in the counter means in response to a second signal from the sensor means and, when the sensed count is inside a predetermined range which contains a predetermined value but is different from the predetermined value, setting the counter means to the predetermined value;

the compensation means further comprising alarm means and means for energizing the alarm means when, in response to the second signal from the sensor means, the count in the counter means is outside the predetermined range which contains the predetermined value.

11. An apparatus as in claim 10, further comprising clutch means for coupling the drive motor to the photoconductive member, the control means disengaging the clutch means while the imaging means forms the electrostatic image on the photoconductive member.

12. An apparatus as in claim 11, in which the imaging means comprises a carriage, a charger, a light source and a linear optical fiber array mounted on the carriage and means for driving the carriage relative to the photoconductive member.

13. An electrostatic copying apparatus including a photoconductive member, imaging means for forming an electrostatic image of an original document on the photoconductive member, developing means for developing the electrostatic image to form a toner image, transfer means for transferring the toner image to a copy sheet and a drive motor for driving the photoconductive member, characterized by comprising:

mark means provided on the photoconductive member;

sensor means for sensing the mark means and producing signals in response thereto;

pulse generator means driven by the motor for generating timing pulses;

counter means for counting the timing pulses;

control means for controlling the imaging means, developing means and transfer means in accordance with predetermined counts in the counter means;

compensation means for resetting the counter means in response to a first signal from the sensor means, sensing a count in the counter means in response to a second signal from the sensor means and, when the sensed count is inside a predetermined range which contains a predetermined value but is different from the predetermined value, setting the counter means to the predetermined value; and clutch means for coupling the drive motor to the photoconductive member, the control means disengaging the clutch means while the imaging means forms the electrostatic image on the photoconductive member;

the photoconductive member being in the form of a belt, the mark means comprising a first mark and a second mark spaced from the first mark in a direction of movement of the photoconductive member, the sensor means producing the first and second signals in response to sensing the first and second marks respectively, the control means disengaging the clutch means in response to the first signal, controlling the imaging means to form the electrostatic image on the belt and then engaging the clutch means, the control means controlling the transfer means to transfer the toner image to the copy sheet in response to the second signal.

14. An apparatus as in claim 13, in which the first and second marks are spaced from each other in such a manner as to divide the belt into two sections of equal length.

15. An electrostatic copying apparatus including a photoconductive member, imaging means for forming an electrostatic image of an original document on the photoconductive member, developing means for developing the electrostatic image to form a toner image, transfer means for transferring the toner image to a copy sheet and a drive motor for driving the photoconductive member, characterized by comprising:

mark means provided on the photoconductive member;

sensor means for sensing the mark means and producing signals in response thereto;

pulse generator means driven by the motor for generating timing pulses;

counter means for counting the timing pulses;

control means for controlling the imaging means, developing means and transfer means in accordance with predetermined counts in the counter means; and compensation means for resetting the counter means in response to a first signal from the sensor means, sensing a count in the counter means in response to a second signal from the sensor means and, when the sensed count is inside a predetermined range which contains a predetermined value but is different from the predetermined value, setting the counter means to the predetermined value;

the counter means comprising first and second counters which are used alternatingly for producing copies of the original document.

16. An apparatus as in claim 15, in which the compensation means is constructed to reset the first counter while sensing the count in the second counter and vice-versa.

17. An electrostatic copying apparatus including a photoconductive member, imaging means for forming an electrostatic image of an original document on the photoconductive member, developing means for developing the electrostatic image to form a toner image, transfer means for transferring the toner image to a copy sheet and a drive motor for driving the photoconductive member, characterized by comprising:

mark means provided on the photoconductive member;

sensor means for sensing the mark means and producing signals in response thereto;

pulse generator means driven by the motor for generating timing pulses;

counter means for counting the timing pulses;

control means for controlling the imaging means, developing means and transfer means in accordance with predetermined counts in the counter means; and compensation means for resetting the counter means in response to a first signal from the sensor means, sensing a count in the counter means in response to a second signal from the sensor means and, when the sensed count is inside a predetermined range which contains a predetermined value but is different from the predetermined value, setting the counter means to the predetermined value;

the drive motor being energized for continuous rotation, the compensation means further comprising alarm means and means for energizing the alarm means when a period of the drive pulses is outside a predetermined range.

18. An apparatus as in claim 17, in which the compensation means is constructed to energize the alarm means only when periods of a predetermined number of drive pulses are sensed as being outside the predetermined range.

* * * * *